US010648126B2

(12) United States Patent
Javit et al.

(10) Patent No.: US 10,648,126 B2
(45) Date of Patent: May 12, 2020

(54) STEAM IRONING APPARATUS COMPRISING A COAT HANGER ON WHICH TO HANG THE GARMENT THAT IS TO BE SMOOTHED

(71) Applicant: SEB S.A., Ecully (FR)

(72) Inventors: Maxime Javit, Lyons (FR); Guy Ducruet, Charbonnieres les Bains (FR); Fang Sylor, Shanghai (CN)

(73) Assignee: SEB S.A., Ecully (FR)

( * ) Notice: Subject to any disclaimer, the term of this patent is extended or adjusted under 35 U.S.C. 154(b) by 22 days.

(21) Appl. No.: 15/776,664

(22) PCT Filed: Nov. 14, 2016

(86) PCT No.: PCT/FR2016/052947
§ 371 (c)(1),
(2) Date: May 16, 2018

(87) PCT Pub. No.: WO2017/085388
PCT Pub. Date: May 26, 2017

(65) Prior Publication Data

US 2018/0327961 A1 Nov. 15, 2018

(30) Foreign Application Priority Data

Nov. 17, 2015 (CN) ..... 2015 1 0790212
Nov. 17, 2015 (FR) ..... 15 61028

(51) Int. Cl.
*D06F 73/00* (2006.01)
*D06F 87/00* (2006.01)

(52) U.S. Cl.
CPC ..... *D06F 73/00* (2013.01); *D06F 87/00* (2013.01)

(58) Field of Classification Search
CPC ..... D06F 73/00; D06F 87/00
(Continued)

(56) References Cited

U.S. PATENT DOCUMENTS 4,892,279 A * 1/1990 Lafferty ..... A61M 5/1415 248/125.8
5,609,047 A * 3/1997 Hellman, Jr. ..... D06F 73/00 239/538
(Continued)

FOREIGN PATENT DOCUMENTS

CN 203360893 U 12/2013
WO WO 2004/023957 A2 3/2004
(Continued)

OTHER PUBLICATIONS

International Search Report as issued in International Patent Application No. PCT/FR2016/052947, dated Feb. 23, 2017.

*Primary Examiner* — Nathan E Durham
(74) *Attorney, Agent, or Firm* — Pillsbury Winthrop Shaw Pittman LLP

(57) ABSTRACT

A steam ironing apparatus includes a base containing a device for producing steam connected by a pipe to a smoothing accessory including a hole for emitting steam. The base includes a coat hanger for hanging a garment and mounted to pivot on the base about an axis by a pivot connection. The hanger is prevented from rotating by a locking device. The locking device includes a control member movable by the user from an unlocked position that allows the hanger to rotate freely, into a locked position in which the hanger is prevented from rotating. The movement of the control member from the unlocked to the locked position causes the movement and/or deformation of a braking element from an initial position that allows free rotation of the pivot connection, towards a braked position in which the braking element is kept pressed against an element to prevent the hanger from rotating.

20 Claims, 5 Drawing Sheets

(58) Field of Classification Search
USPC ..... 223/51, 120
See application file for complete search history.

(56) References Cited

U.S. PATENT DOCUMENTS

| | | | | |
|---|---|---|---|---|
| 2004/0050118 | A1* | 3/2004 | Carrubba | D06F 73/00 68/222 |
| 2008/0040953 | A1* | 2/2008 | Leung | D06F 75/12 38/77.6 |
| 2008/0217364 | A1 | 9/2008 | Fong | |
| 2009/0173758 | A1* | 7/2009 | Hahn | D06F 57/02 223/85 |
| 2015/0114048 | A1* | 4/2015 | Ducruet | D06F 87/00 68/5 A |

FOREIGN PATENT DOCUMENTS

| | | | |
|---|---|---|---|
| WO | WO 2007/108577 | A1 | 9/2007 |
| WO | WO 2012/054433 | A2 | 4/2012 |

* cited by examiner

STEAM IRONING APPARATUS COMPRISING A COAT HANGER ON WHICH TO HANG THE GARMENT THAT IS TO BE SMOOTHED

CROSS-REFERENCE TO RELATED APPLICATIONS

This application is the U.S. National Stage of PCT/FR2016/052947 filed Nov. 14, 2016, which in turn claims priority to French patent application number 1561028 filed Nov. 17, 2015 and Chinese patent application number 201510790212.9 filed Nov. 17, 2015. The content of these applications are incorporated herein by reference in their entireties.

FIELD

This invention relates to a steam ironing apparatus comprising a base containing a device for producing a stream of steam connected by a pipe to a smoothing accessory comprising at least one hole for emitting steam and relates more particularly to an apparatus in which the base comprises a coat hanger on which the garment to be smoothed can be hung while the smoothing accessory is in use, the coat hanger being mounted with the ability to pivot on the base and being able to be prevented from rotating by means of a locking device.

BACKGROUND

From the patent application CN203360893U, a steam ironing apparatus is known, comprising a steam-generating base comprising a pole equipped with a coat hanger at its upper extremity, the coat hanger being mounted with the ability to rotate around the longitudinal axis of the pole and comprising a locking device making it possible to immobilize the coat hanger in different predetermined angular positions.

Such an ironing apparatus equipped with a rotating coat hanger has the advantage of making the garment smoothing operation more ergonomic by permitting the user to turn the garment around the pole and then immobilize it in various angular positions.

However, the coat hanger locking device disclosed in this document has the disadvantage of permitting the coat hanger to be immobilized in only a limited number of predetermined positions. In addition, the locking device disclosed in this document has the disadvantage of not adequately preventing the rotation of the coat hanger when the spring used in the locking device is not very rigid, and of being difficult to assemble when the spring used is rigid enough to immobilize the coat hanger properly. Finally, the locking device described in this document makes use of a spring-mounted ratchet system which has the disadvantage of being relatively noisy when the user manually changes the position of the coat hanger.

SUMMARY

Also, one objective of this invention is to propose an ironing apparatus that corrects these disadvantages and is simple and economical to make.

For this purpose, the objective of the invention is a steam ironing apparatus comprising a base containing a device for producing a stream of steam connected by a pipe to a smoothing accessory comprising at least one hole for emitting steam, the base comprising a coat hanger on which the garment to be smoothed can be hung while the smoothing accessory is in use, the coat hanger being mounted with the ability to pivot on the base around an axis using a pivot connection and being able to be prevented from rotating by means of a locking device, characterized in that the locking device comprises a control member that can be moved by the user by hand from an unlocked position that allows the coat hanger to rotate freely, into a locked position in which the coat hanger is prevented from rotating, and in that the movement of the control member from the unlocked position into the locked position causes the movement and/or deformation of a braking element from an initial position that allows the pivot connection to rotate freely, towards a braked position in which the braking element is kept pressed against an element to prevent the coat hanger from rotating and permits the coat hanger to be locked around the axis in any angular position.

Such an apparatus equipped with a locking device equipped with a friction braking element has the advantage of being simple and economical to implement and of ensuring the immobilization of the coat hanger by only the friction forces generated by the pressure exerted by the braking element, thus permitting the coat hanger to be locked in any angular position. In addition, such a device has the advantage of being sturdy and silent.

According to another characteristic of the invention, the braking element is integral in translation with a rod and the control member consists of a control lever mounted with the ability to pivot at one extremity of the rod, the control lever comprising a portion forming a cam provoking the movement in translation of the rod during the pivot of the control lever.

Such a control member has the advantage of being simple and economical to make, of ensuring good compression of the braking element and of being very ergonomic to use.

According to another characteristic of the invention, the control lever is rotated by an angle of between 45° and 90°, and advantageously approximately 90°, to move from the unlocked position into the locked position, and the control lever is advantageously arranged substantially perpendicular to the rod when it is in either the locked or unlocked position, and is aligned with the rod when it is in the other position.

According to another characteristic of the invention, the braking element is an elastically deformable element that changes from an initial form, advantageously having a small diameter, into a modified form, advantageously having a larger diameter, when the control lever moves from the unlocked position into the locked position, the braking element changing from the initial form into the modified form by being deformed by the force exerted by a part integral with the rod.

Such a deformable braking element has the advantage of offering greater flexibility during operation of the control lever and of permitting a possible rotation of the coat hanger without damaging the locking device when the user pushes on the coat hanger to make it turn without having first placed the control lever in the unlocked position.

According to another characteristic of the invention, the pivot connection that permits the coat hanger to rotate on the base comprises a shaft mounted with the ability to rotate in a bearing, the braking element being compressed between a disk and an extremity of the shaft when the control lever is in the locked position.

According to another characteristic of the invention, the braking element consists of an elastomer ring.

According to yet another characteristic of the invention, the braking element consists of a rigid flange, advantageously frustoconical in shape.

A rigid flange refers to a flange whose deformation is substantially invisible when the flange is brought from the initial position into the locked position.

For example, the flange could be made of polycarbonate.

Such a characteristic has the advantage of making it possible to prevent rotation of the coat hanger more effectively.

According to another characteristic of the invention, the pivot connection that permits the coat hanger to rotate on the base comprises a hollow shaft, mounted with the ability to rotate in a bearing, the flange being arranged in a liner fixed at one extremity of the shaft.

Such a characteristic permits obtaining a locking device that is compact and easy to assemble.

According to another characteristic of the invention, the liner comprises an upper extremity equipped with a frustoconical wall against which the flange rests when the control lever is in the locked position.

According to another characteristic of the invention, the control member is arranged in a cavity of the coat hanger, the cavity advantageously leading to the two opposite sides of the coat hanger.

Such a characteristic permits having a control member that is integrated in the volume of the coat hanger and does not interfere with the placement of garments on the coat hanger. In addition, when the cavity leads to the two sides of the coat hanger, this permits having easy access to the control member regardless of the orientation of the coat hanger. According to another characteristic of the invention, the base comprises a vertical pole, advantageously telescopic, which holds the coat hanger.

According to another characteristic of the invention, the coat hanger is arranged close to the top of the pole.

According to another characteristic of the invention, the accessory is a smoothing brush or an iron.

According to another characteristic of the invention, the coat hanger comprises an indentation intended to receive the smoothing head, the indentation holding the smoothing head in position on the coat hanger when the user does not wish to use it.

According to yet another characteristic of the invention, the cavity receiving the control member is arranged at the base of the indentation.

According to another characteristic of the invention, the axis of rotation of the coat hanger is arranged substantially vertically when the base lies on the ground.

According to another characteristic of the invention, the axis of rotation of the coat hanger is arranged coaxial to the pole.

BRIEF DESCRIPTION OF THE DRAWINGS

The objects, aspects, and advantages of this invention will be more fully understood in consideration of the following description of a particular embodiment of the invention presented as a non-restrictive example, by referring to the attached drawings in which.

Only the elements necessary for understanding the invention have been represented. To facilitate reading of the drawings, the same elements bear the same references from one figure to the next.

DETAILED DESCRIPTION

Figure 1:
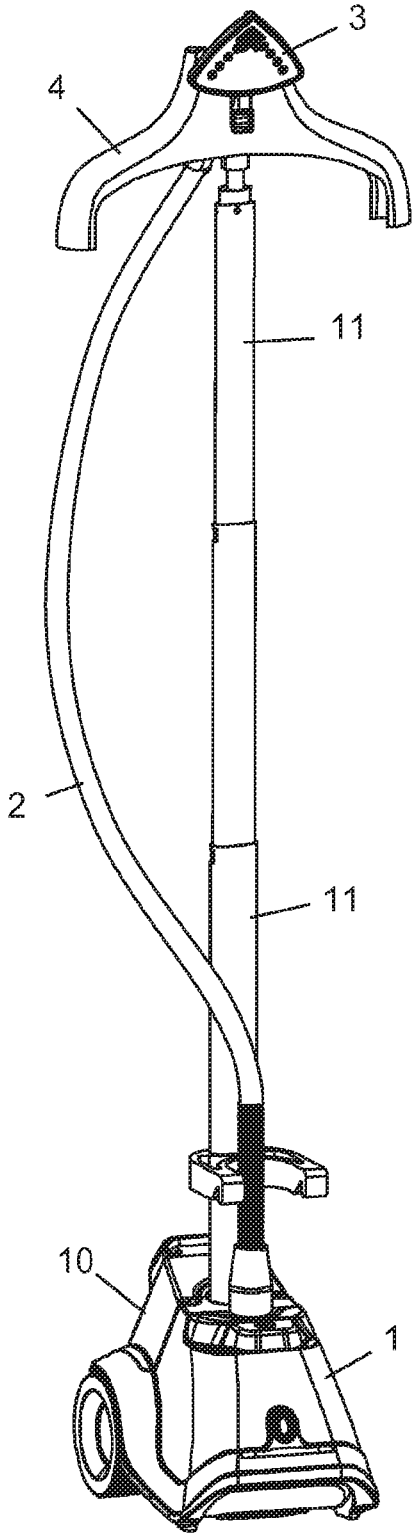
FIG. 1 is a perspective view of an ironing apparatus according to the invention.

FIG. 1 represents a steam ironing apparatus comprising a base 1 for generating steam connected by a flexible pipe 2 to a smoothing brush 3 comprising holes for emitting steam, the base 1 comprising, in a manner known per se, a water tank 10 connected to a boiling chamber, not represented in the figures, permitting the continuous production of a stream of saturated steam, the boiling chamber being connected directly to the flexible pipe 2 such that the steam produced by the boiling chamber can escape freely toward the steaming brush 3.

Such a base 1 for steam generation is well known to those skilled in the art, and is, for example, technically similar to the base for steam generation described in detail in the patent application WO 2004/023957.

Preferably, the base 1 comprises a pole 11 having three telescopic sections extending substantially vertically when the base 1 lies flat on the ground, the pole 11 comprising an upper extremity supporting a coat hanger 4 on which the clothing to be smoothed may be hung. The coat hanger 4 is advantageously made of a plastic material and comprises an indentation 40 at its top, better visible in FIG. 2, which forms a housing to hold the smoothing brush 3.

Figure 2:
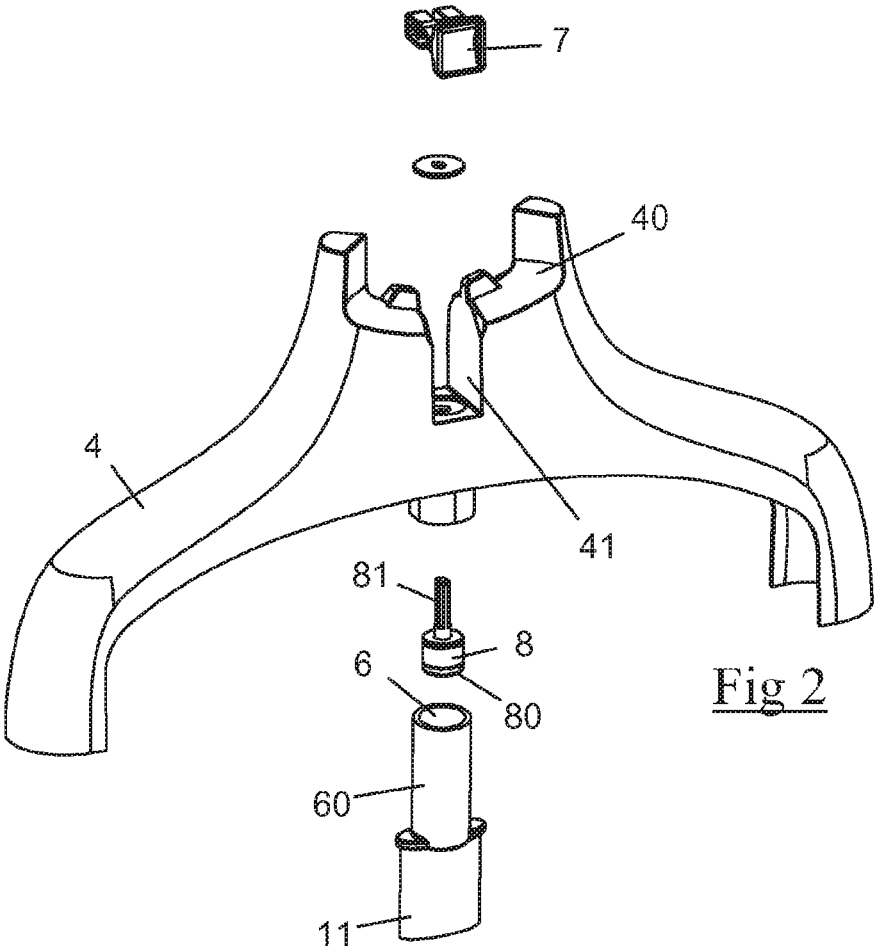
FIG. 2 is an exploded perspective view of a first embodiment of a system for coupling the coat hanger to the pole intended to equip the apparatus in FIG. 1.
Figure 3:
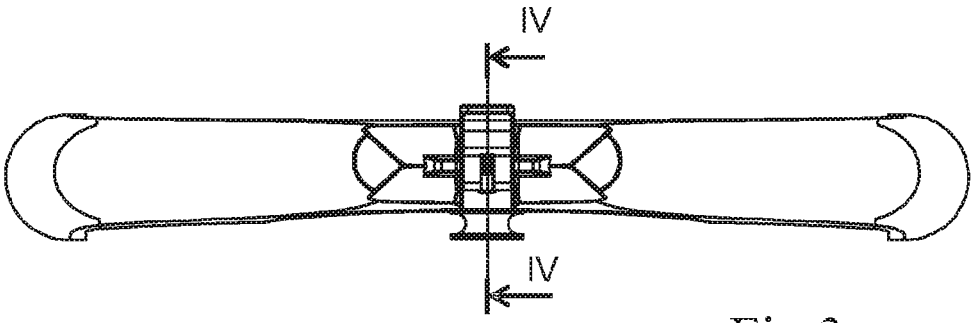
FIG. 3 is a view of the top of the coat hanger in FIG. 2.
Figure 4A:
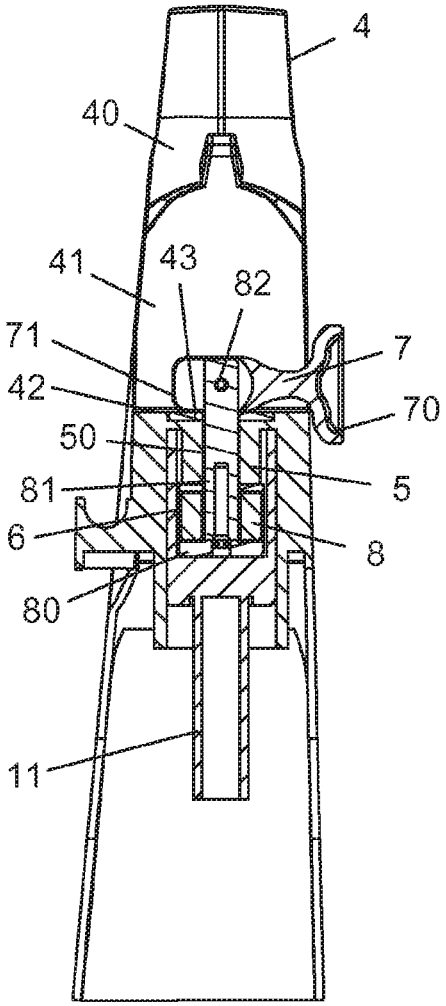
FIGS. 4A and 4B are cross-sectional views according to line IV-IV of FIG. 3, with the control lever in an unlocked position and a locked position, respectively.

In accordance with FIGS. 2 and 4A, the coat hanger 4 is mounted with the ability to pivot on the pole 11 around an axis coaxial with the longitudinal axis of the pole 11, the rotation of the coat hanger 4 being obtained by means of a pivot connection comprising a shaft 5, integral with the coat hanger 4, which turns in a bearing 6 held by a sleeve 60 arranged at the upper extremity of the pole 11.

More specifically according to the invention, the apparatus comprises a locking device which permits locking the coat hanger 4 in position, the locking device comprising a control lever 7 which may be in an unlocked position in which the coat hanger 4 is able to turn freely around the pole 11 and a locked position in which the coat hanger 4 is locked in position.

Figure 4B:
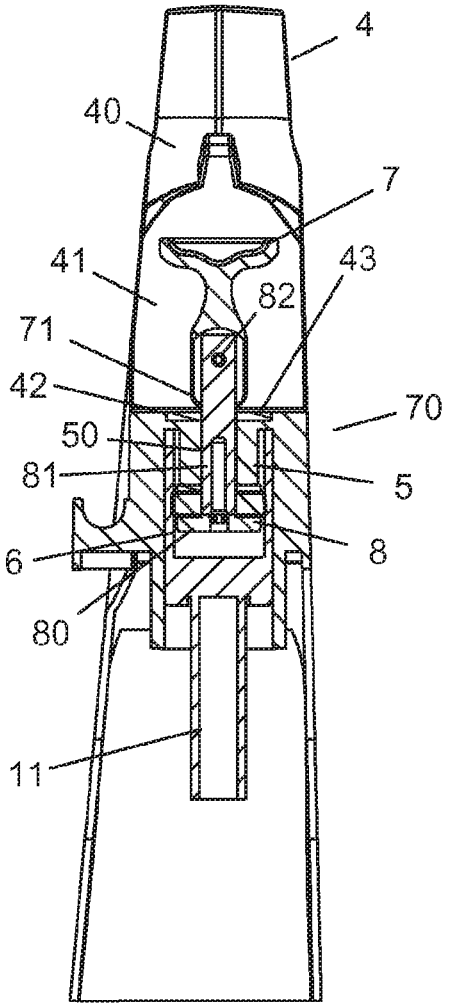

In the first embodiment illustrated in FIGS. 2, 4A and 4B, the locking device comprises an elastically deformable braking element 8 arranged at a lower extremity of the shaft 5, inside the bearing 6, the braking element 8 being sandwiched between the lower extremity of the shaft 5 and a disk 80 fixed at a lower extremity of a rod 81 mounted with the ability to slide in the shaft 5 and whose top extremity is connected to the control lever 7.

The braking element advantageously consists of an elastic spacer 8, made of an elastomer material, having a thickness of approximately 1 cm and which the rod 81 goes through, the elastic spacer 8 having an annular shape which, when it is not compressed, presents an outer diameter of approximately 2 cm, corresponding to the diameter of the shaft 5.

Preferably, the rod 81 has a cross section in the shape of a cross which slides into an opening 50 having a complementary shape arranged at the center of the shaft 5 in order to prevent the rod 81 from rotating on itself.

As can be seen in FIGS. 4A and 4B, the rod 81 comprises an upper extremity which leads, at the outside of the coat hanger 4, to a cavity 41 formed at the base of the indentation 40 intended to receive the smoothing head 3, the upper extremity of the rod 81 being connected to the control lever 7 by a pivot connection with an axis 82 perpendicular to the longitudinal axis of the rod 81.

The control lever 7 has an upper portion 70 forming a gripping area, and a lower portion forming a cam 71 that comes into contact with a wall 42 arranged in the bottom of the cavity 41, the cam 71 having a form adapted to cause the movement in translation of the rod 81 in the direction of bringing the disk 80 toward the lower extremity of the shaft 5 when the control lever 7 switches from the unlocked position, illustrated in FIG. 4A, to the locked position, illustrated in FIG. 4B.

Preferably, the portion of the wall 42 on which the cam 71 rests comprises a metallic washer 43 which locally reinforces the support area in order to avoid excessively rapid wear of the wall 42 in contact with the cam 71 during the manipulation of the control lever 7.

The functioning of the locking device will now be described in relation to FIGS. 4A and 4B.

When the user wishes to be able to turn the coat hanger 4 freely around the pole 11, he places the control lever 7 in the unlocked position illustrated in FIG. 4A, in which the control lever 7 is turned 90° with respect to the axis of the rod 81. In this position, the shape of the cam 71 permits the rod 81 to descend through the opening 50 of the shaft such that the disk 80 does not exert pressure on the elastic spacer 8 which then presents an initial form in which the outer diameter of the elastic spacer 8 is smaller than the inner diameter of the bearing 6.

In this position of the control lever 7, the shaft 5 may turn freely in the bearing 6 and the coat hanger 4 may be oriented by the user by hand to the position desired.

When the user wishes to lock the coat hanger 4 in a given position, he has only to grasp the control lever 7 and make it turn by 90° toward the locked position illustrated in FIG. 4B, in which the control lever 7 is aligned with the axis of the rod 81. The switching of the control lever 7 toward this locked position provokes an upward movement of the rod 81, because of the profile of the cam 71 which rests on the washer 43 covering the wall 42, such that the disk 80 compresses the elastic spacer 8 against the lower extremity of the shaft 5. This compression provokes a deformation of the elastic spacer 8, in particular a swelling of its diameter, which then rubs against the bearing 6 and prevents the shaft 5 from rotating. The coat hanger 4 is then locked in position and the user may perform ironing operations without risk of rotation of the coat hanger 4.

Of course, if the user wishes to be able to turn the coat hanger 4 on the pole 11, he only has to again put the control lever 7 into the unlocked position in order to release the pressure exerted by the elastic spacer 8 on the bearing 6.

Such a locking device thus has the advantage of being simple and economical to make and permits locking the coat hanger in any angular position. In addition, such a locking device has the advantage of not breaking when the user pushes on the coat hanger in order to turn it without having first positioned the control level in the unlocked position. In fact, when such a situation occurs, the elastic spacer starts to slide inside the bearing when the torque exerted becomes greater than the friction forces, preventing breakage of the locking device.

Figure 5:
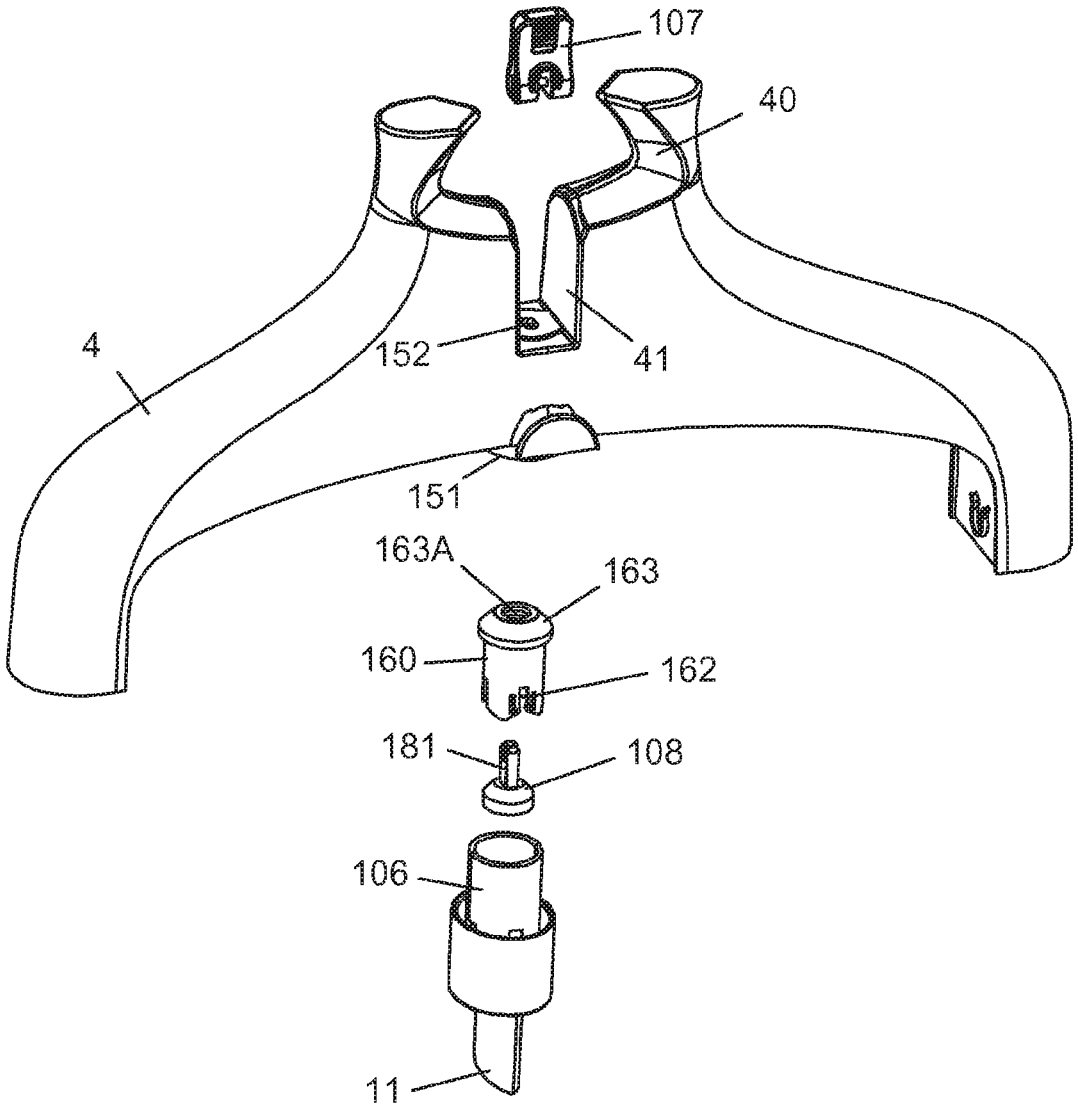
FIG. 5 is an exploded perspective view of a second embodiment of a system for coupling the coat hanger to the pole intended to equip the apparatus in FIG. 1.
Figure 6A:
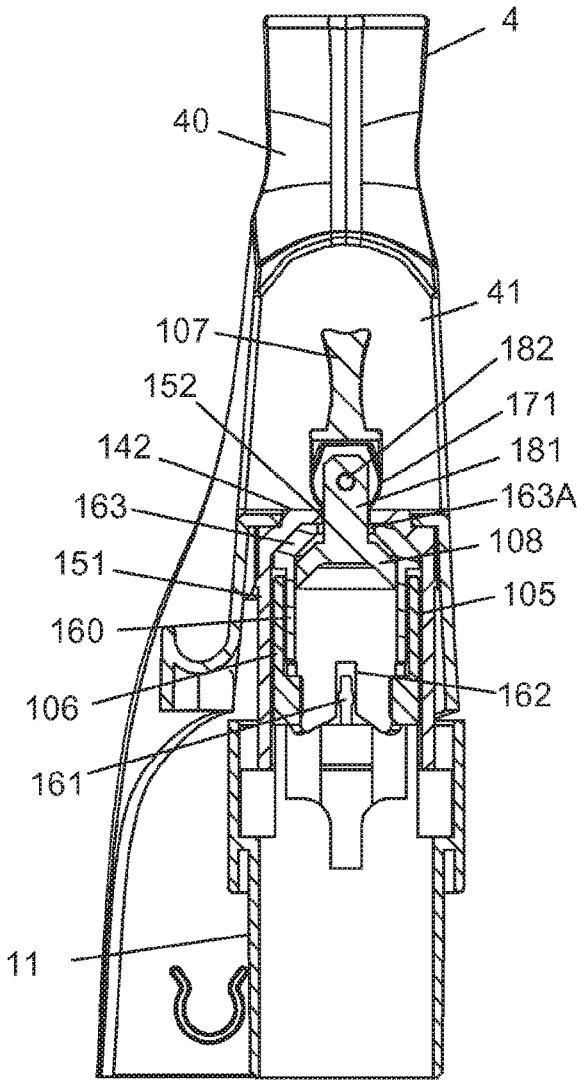
FIGS. 6A and 6B are cross-sectional views of the coat hanger in FIG. 5, according to a cutting plane similar to the one in FIGS. 4A and 4B, with the control lever in an unlocked position and a locked position, respectively.
Figure 6B:
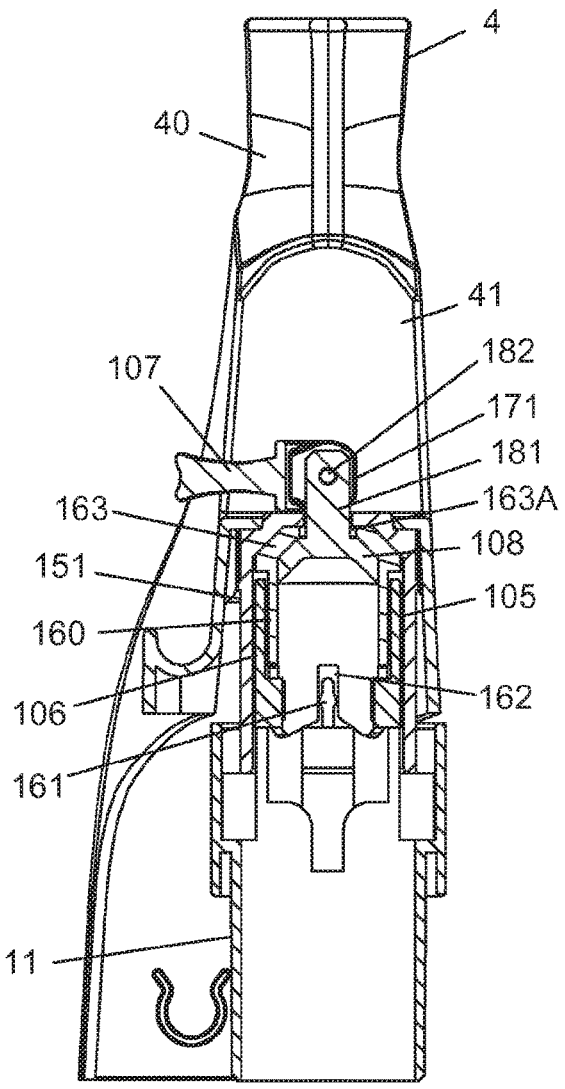

FIGS. 5, 6A and 6B illustrate a second embodiment of the device for preventing rotation of the coat hanger 4 that may equip the device in FIG. 1, the coat hanger 4 being mounted with the ability to pivot on the pole 11 by means of a pivot connection comprising a hollow shaft 106 arranged at the upper extremity of the pole 11, the shaft 106 turning inside a bearing 105 arranged in a sleeve 151 integral with the coat hanger 4 and being coaxial with the longitudinal axis of the pole 11.

In this second embodiment, the locking device comprises a braking element consisting of a flange 108 made of a rigid plastic material like polycarbonate and is generally frustoconical in shape.

The flange 108 is arranged in a liner 160 attached inside the shaft 106 and made integral in rotation with the latter by the insertion of fingers 161 held by the inner surface of the shaft 106 in slots 162 arranged in the liner 160.

The liner 160 is inserted in the hollow shaft 106 through the top of the latter and comprises an upper extremity closed by a frustoconical wall 163 comprising a lower surface whose shape is complementary to the frustoconical flange 108.

The flange 108 is fixed to the lower extremity of a rod 181 going through an opening 163A arranged at the top of the frustoconical wall 163 and is mounted with the ability to slide in translation in an opening 152 arranged at the upper extremity of the sleeve 151, the rod 181 having a non-circular cross section cooperating with the shape of the opening 152 in order to prevent the rotation of the rod 181 in the opening 152 such that the coat hanger 4 is integral in rotation with the rod 181. As an example, the rod 181 and the opening 152 have a rectangular cross section.

As can be seen in FIGS. 6A and 6B, the rod 181 comprises an upper extremity which leads to a cavity 41 formed at the base of the indentation 40 of the coat hanger, the upper extremity of the rod 181 being connected to a control lever 107 by a pivot connection with an axis 182 perpendicular to the longitudinal axis of the rod 181.

The control lever 107 has an upper portion forming a gripping area, and a lower portion forming a cam 171 that comes into contact with a wall 142 arranged in the bottom of the cavity 41, the cam 171 having a form adapted to cause the movement in translation of the rod 181 in the direction of pressing the flange 108 against the frustoconical wall 163 of the liner 160 when the control lever 107 switches from the unlocked position, illustrated in FIG. 6A, to the locked position, illustrated in FIG. 6B.

The functioning of the locking device according to the second embodiment will now be described in relation to FIGS. 6A and 6B.

When the user wishes to be able to turn the coat hanger 4 freely around the pole 11, he places the control lever 107 in the unlocked position, illustrated in FIG. 6A, in which the control lever 107 is aligned axially with the rod 181. In this position, the shape of the cam 171 permits the rod 181 to descend through the opening 152 of the sleeve 151 such that the flange 108 is in an initial position in which the frustoconical wall of the flange 108 does not exert pressure against the frustoconical wall 163 of the liner 160.

In this position of the control lever 107, the sleeve 151 may turn freely on the shaft 106 and the coat hanger 4 may be oriented by the user by hand to the position desired.

When the user wishes to lock the coat hanger 4 in a given position, he has only to grasp the control lever 107 and make it turn by 90° toward the locked position illustrated in FIG. 6B. The switching of the control lever 107 toward this locked position provokes an upward movement of the rod 181, because of the profile of the cam 171 which rests on the wall 142, such that the flange 108 is pressed against the frustoconical wall 163 of the liner 160. The upper surface of the flange 108 then rubs against the inner surface of the frustoconical wall 163 and prevents the rotation of the rod 181 with respect to the liner 160. However, the liner 160 being made integral in rotation with the shaft 106 through the insertion of fingers 161 in the slots 162, the prevention of rotation of the rod 181 with respect to the shaft 106 prevents the rotation of the coat hanger 4 on the pole 11 which is then locked in position. The user may then perform ironing operations without risk of rotation of the coat hanger 4.

Of course, if the user wishes to be able to turn the coat hanger 4 on the pole 11, he only has to again put the control lever 107 into the unlocked position in order to release the pressure exerted by the flange 108 on the frustoconical wall 163.

The locking device according to this second embodiment has the advantage of being simple and economical to make and preventing rotation of the coat hanger more effectively than the locking device described in the first embodiment thanks to the rubbing of the flange in rigid material against the frustoconical wall of the liner.

Of course, the invention is in no way limited to the embodiment described and illustrated, which has been provided only as an example. Modifications are still possible, in particular from the point of view of composition of the various components or by substitution of equivalent techniques, without departing from the scope of protection of the invention.

Thus, in another embodiment variant not represented, the apparatus may comprise, in addition to the coat hanger, an upper bar equipped with clips, extending between the two longitudinal extremities of the coat hanger, making it possible to hold the garment to be ironed.

Thus, in another embodiment variant not represented, the coat hanger may also comprise an ironing surface, such as a screen, that may be held vertically between the coat hanger and a lower bar attached to the pole.

Thus, in an embodiment variant not represented, the control member of the locking device may consist of a lever mounted with the ability to rotate around the longitudinal axis of the rod, the lever resting on a wall equipped with raised portions forming cams such that the rotation of the lever around the longitudinal axis of the rod causes the displacement in translation of the lever according to this longitudinal axis.

The invention claimed is:

1. A steam ironing apparatus comprising a base containing a device for producing a stream of steam connected by a pipe to a smoothing accessory comprising at least one hole for emitting steam, the base comprising a coat hanger on which a garment to be smoothed can be hung while the smoothing accessory is in use, the coat hanger being mounted with the ability to pivot on the base around an axis using a pivot connection and being able to be prevented from rotating by a locking device, wherein the locking device comprises a control member that is movable by the user by hand from an unlocked position that allows the coat hanger to rotate freely, into a locked position in which the coat hanger is prevented from rotating, and wherein a movement of the control member from the unlocked position into the locked position causes the movement or deformation, or both the movement and deformation, of a braking element from an initial position that allows the pivot connection to rotate freely 360° around the axis, towards a braked position in which the braking element is kept pressed against an element to prevent the coat hanger from rotating and permits the coat hanger to be locked around the axis in any angular position, wherein the braking element and a rod are movable together in translation and wherein the control member consists of a control lever mounted with the ability to pivot at one extremity of the rod, the control lever comprising a portion forming a cam provoking the movement in translation of the rod during the pivot of the control lever.

2. The steam ironing apparatus according to claim 1, wherein the control lever is rotated by an angle of between 45° and 90° to move from the unlocked position into the locked position.

3. The steam ironing apparatus according to claim 2, wherein the control lever is arranged perpendicular to the rod when the control lever is in either the locked or unlocked position, and is aligned with the rod when the control lever is in the other position.

4. The steam ironing apparatus according to claim 1, wherein the braking element is an elastically deformable element that changes from an initial form into a modified form because of the force exerted by a part integral with the rod when the control lever moves from the unlocked position into the locked position.

5. The steam ironing apparatus appliance according to claim 4, wherein the pivot connection that permits the coat hanger to rotate on the base comprises a shaft mounted with the ability to rotate in a bearing and wherein the braking element is compressed between a disk and an extremity of the shaft when the control lever is in the locked position.

6. The steam ironing apparatus according to claim 1, wherein the braking element consists of a rigid flange that extends from a rod.

7. The steam ironing apparatus according to claim 6, wherein the rigid flange has a frustoconical shape.

8. The steam ironing apparatus according to claim 1, wherein the control member is arranged in a cavity of the coat hanger.

9. The steam ironing apparatus according to claim 8, wherein the cavity leads to two opposite sides of the coat hanger.

10. The steam ironing apparatus according to claim 1, wherein the base comprises a vertical pole, which holds the coat hanger.

11. The steam ironing apparatus according to claim 10, wherein the vertical pole is telescopic.

12. The steam ironing apparatus according to claim 1, wherein the accessory is a smoothing brush or an iron.

13. A steam ironing apparatus comprising a base containing a device for producing a stream of steam connected by a pipe to a smoothing accessory comprising at least one hole for emitting steam, the base comprising a coat hanger on which a garment to be smoothed can be hung while the smoothing accessory is in use, the coat hanger being mounted with the ability to pivot on the base around an axis using a pivot connection and being able to be prevented from rotating by a locking device, wherein the locking device comprises a control member that is movable by the user by hand from an unlocked position that allows the coat hanger to rotate freely, into a locked position in which the coat hanger is prevented from rotating, and wherein a movement of the control member from the unlocked position into the locked position causes the movement or deformation, or both the movement and deformation, of a braking element from an initial position that allows the pivot connection to rotate freely 360° around the axis, towards a braked position in which the braking element is kept pressed against an element to prevent the coat hanger from rotating and permits the coat hanger to be locked around the axis in any angular position, wherein the braking element consists of a rigid flange that extends from a rod, and wherein the pivot connection that permits the coat hanger to rotate on the base comprises a hollow shaft mounted with the ability to rotate in a bearing and wherein the flange is arranged in a liner fixed at one extremity of the shaft.

14. The steam ironing apparatus according to claim 13, wherein the braking element and the rod are movable together in translation and wherein the control member consists of a control lever mounted with the ability to pivot at one extremity of the rod, the control lever comprising a portion forming a cam provoking the movement in translation of the rod during the pivot of the control lever.

15. The steam ironing apparatus according to claim 14, wherein the control lever is rotated by an angle of between 45° and 90° to move from the unlocked position into the locked position.

16. The steam ironing apparatus according to claim 15, wherein the control lever is arranged perpendicular to the rod when the control lever is in either the locked or unlocked position, and is aligned with the rod when the control lever is in the other position.

17. The steam ironing apparatus according to claim 13, wherein the control member is arranged in a cavity of the coat hanger.

18. The steam ironing apparatus according to claim 13, wherein the base comprises a vertical pole, which holds the coat hanger.

19. The steam ironing apparatus according to claim 13, wherein the accessory is a smoothing brush or an iron.

20. The steam ironing apparatus according to claim 13, wherein the rigid flange has a frustoconical shape.

* * * * *